US007406782B2

(12) United States Patent
Valat et al.

(10) Patent No.: US 7,406,782 B2
(45) Date of Patent: Aug. 5, 2008

(54) SET COMPRISING TWO ARTICULATED BOOTS HAVING DIFFERENT MECHANICAL PROPERTIES

(75) Inventors: Gerard Valat, Aix en Provence (FR); Cedric Ragot, Paris (FR)

(73) Assignee: Random Design, Aix en Provence (FR)

( * ) Notice: Subject to any disclaimer, the term of this patent is extended or adjusted under 35 U.S.C. 154(b) by 298 days.

(21) Appl. No.: 10/536,905

(22) PCT Filed: Nov. 24, 2003

(86) PCT No.: PCT/FR03/03469

§ 371 (c)(1),
(2), (4) Date: May 27, 2005

(87) PCT Pub. No.: WO2004/049851

PCT Pub. Date: Jun. 17, 2004

(65) Prior Publication Data

US 2006/0005430 A1 Jan. 12, 2006

(30) Foreign Application Priority Data

Nov. 27, 2002 (FR) ..... 02 14902

(51) Int. Cl.
*A43B 3/02* (2006.01)
*A43B 5/16* (2006.01)
*A43B 5/04* (2006.01)

(52) U.S. Cl. ..... 36/118.2; 36/118.5; 36/118.3

(58) Field of Classification Search ..... 36/117.1, 36/117.5, 119.1, 118.2–118.9

See application file for complete search history.

(56) References Cited

U.S. PATENT DOCUMENTS

| | | | | | |
|---|---|---|---|---|---|
| 3,303,584 | A | * | 2/1967 | Werner et al. | 36/118.7 |
| 3,732,635 | A | * | 5/1973 | Marker | 36/117.5 |
| 3,786,581 | A | * | 1/1974 | Mochizuki | 36/118.2 |
| 3,906,645 | A | | 9/1975 | Heckel | |
| 3,945,134 | A | * | 3/1976 | Ramer | 36/117.2 |
| 4,085,528 | A | * | 4/1978 | Delery | 36/119.1 |
| 4,258,482 | A | * | 3/1981 | Salomon | 36/118.5 |
| 4,546,558 | A | * | 10/1985 | Perini | 36/117.5 |
| 4,622,765 | A | * | 11/1986 | Baratto et al. | 36/118.7 |
| 5,175,948 | A | * | 1/1993 | Tonel et al. | 36/118.3 |
| 5,675,917 | A | * | 10/1997 | Falguere et al. | 36/117.2 |

(Continued)

FOREIGN PATENT DOCUMENTS

| | | | |
|---|---|---|---|
| EP | 0 774 218 | | 5/1997 |
| EP | 0 811 329 | | 12/1997 |
| EP | 0 841 015 | | 5/1998 |
| EP | 0 857 501 | | 8/1998 |
| FR | 2 063 555 | | 7/1971 |
| FR | 2 656 776 | | 7/1991 |
| JP | 06178701 | A * | 6/1994 |
| WO | WO 01/89335 | | 11/2001 |

*Primary Examiner*—Marie Patterson
(74) *Attorney, Agent, or Firm*—Young & Thompson

(57) ABSTRACT

A footwear designed for a plurality of sports for protecting a user's feet and legs includes a first rigid shell defining a body (2) adapted to receive a user's foot and extending along an elongation direction (8); a second rigid shell defining an upper (4) designed to receive the user's leg and extending substantially along a rising direction (10); an articulation (6), linking the body to the upper, having specific mechanical strength characteristics. A range of articulations having different mechanical strength characteristics can be fixed to the first and second shells to accommodate the physiological differences between the various uses of such footwear articles and/or to the differences between the various sports for which the footwear articles may be used.

20 Claims, 3 Drawing Sheets

Figure 4:
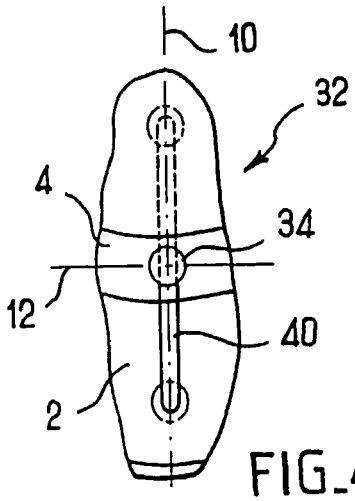

U.S. PATENT DOCUMENTS 5,740,620 A * 4/1998 Giese et al. ..... 36/118.2
5,832,635 A * 11/1998 Finney et al. ..... 36/118.8
5,903,984 A * 5/1999 Donnadieu et al. ..... 36/118.2
6,006,452 A * 12/1999 Bonaventure ..... 36/118.8
2002/0088146 A1 * 7/2002 Joseph et al. ..... 36/117.3

* cited by examiner

SET COMPRISING TWO ARTICULATED BOOTS HAVING DIFFERENT MECHANICAL PROPERTIES

This invention relates to a footwear article of a new type designed to protect the feet and legs of a user when engaging in an extreme sport.

Yet known footwear articles comprise:

- a first rigid shell defining a body intended to receive the foot of a user and extending in a longitudinal direction,
- a second rigid shell defining a top intended to receive the user's leg and extending substantially in an upward direction,
- a articulation connecting the body and the top having specific mechanical resistance characteristics.

Such a footwear article is in particular disclosed in FR-A-2 656 776 or WO-A-01 89335.

The object of the invention is to improve the protection and comfort of users, and to increase the production volumes of such articles.

In order to do this the invention provides for the provision of a set of articulations having different mechanical resistance characteristics to adjust to the physiological differences between the users of such footwear articles and/or differences between the sports for which the said footwear articles may be used.

Furthermore, according to the invention, the first shell, to which the articulation is linked, may be used for many sports without any technical modification (apart from a few aesthetic differences) and for all users whose feet have substantially the same dimensions (in other words the same shoe size).

Finally, still according to the invention, the second shell to which the articulation is linked may be used without any fundamental technical modification for all users whose feet have substantially the same dimensions. In other words it is possible to provide a range of second similar shells to cover a range of sports. Within the range of second shells there may be a number of minor technical differences between the second shells (slight shortening of the top in some cases) for the practice of particular sports.

In other words the invention relates to a set comprising at least:

- a first footwear article intended for the practice of a first sport comprising:
  - a first rigid shell defining a body intended to receive the foot of a first user and extending in a longitudinal direction,
  - a second rigid shell defining a top intended to receive the leg of the user and substantially extending in an upward direction,
  - an articulation connecting the body and the top having specific mechanical resistance characteristics,
- a second footwear article also intended for the practice of a second sport, comprising:
  - a first rigid shell defining a body intended to receive the foot of a second user and extending in a longitudinal direction,
  - a second rigid shell defining a top intended to receive the leg of the user and substantially extending in an upward direction,
  - an articulation connecting the body and the top having specific mechanical resistance characteristics, in which:
- the first shell of the first footwear article is substantially identical to the first shell of the second footwear article,

- the second shell of the first footwear article and the second shell of the second footwear article are similar,
- the mechanical characteristics of the articulation of the first footwear article and the mechanical characteristics of the articulation of the second footwear article are substantially different in order to correspond to the physiological differences in the first and second user and/or differences between the first and second sport.

Thus on the one hand the mechanical characteristics of the articulations will be better suited to the physiological characteristics (in particular weight and muscular strength) of the users and on the other hand it will be possible to cover an extensive range of sports such as motocross, snowboarding, mountain biking or roller blading without having to design a new product.

In accordance with an advantageous feature of the invention, in particular when the first and second footwear articles are intended for the same sport, the second shell of the first footwear article is substantially identical to the second shell of the second footwear article.

The cost of manufacturing footwear articles is thus reduced.

According to another advantageous feature of the invention, the articulation for each footwear article is separate from the first shell and the second shell, and the articulation for the first footwear article can replace the articulation of the second footwear article and vice versa.

It will be understood that the articulation of the first article may replace the articulation of the second article in particular where the space provided in the first and the second shell of the second footwear article is sufficient to receive the first articulation, and the areas for attachment of the first articulation coincide with the areas of attachment for the first shell and the second shell of the second footwear article, the said attachment areas receiving attachment means designed to hold the articulation on the first and second shells.

Vendors will thus be able to stock footwear articles without articulations and the articulations, and to assemble them in relation to the customer's physiological characteristics and the sport in which he intends to engage without having to stock all possible combinations, as a result of which stocks can be reduced. In addition to this it is possible to replace the articulation alone, when it has been damaged and the remainder of the footwear article is still in good condition.

In order to improve the user's comfort still further without reducing protection the invention provides that the articulation for each footwear item will permit rotation of the top in relation to the body in two axes of rotation which are substantially perpendicular to each other and lateral movement of the hinge axis in relation to the body to cause the axis of rotation of the articulation to coincide substantially with the axis of rotation of the user's foot in relation to his leg.

In this way the boot will match the user's shape, and provide greater mobility and a feeling of greater flexibility by more faithfully following the complexity of the ankle's movements.

A simple and robust articulation having the aforesaid characteristics will be such that:

- the articulation of the first footwear article and the articulation of the second footwear article will each comprise two elastically deformable members located symmetrically in relation to the upward direction,
- each elastically deformable member will comprise two substantially inwardly curving ribs which are located opposite each other (back to back or front to front).

In order to obtain different mechanical characteristics between the articulations of the first and second footwear articles according to the invention, the ribs of the first footwear article and the ribs of the second footwear article are constructed of different materials.

Provision may also be made for ribs of different cross-section for the first and second footwear articles.

According to another advantageous feature of the invention, the two elastically deformable members for each footwear article will have different mechanical characteristics.

Thus the deformation resistance characteristics may be matched more precisely to the user's needs for protection, in particular because of the imperfect symmetry of the ankle link between the foot and the leg.

In order to increase protection of the user according to another advantageous feature, the upward direction and the longitudinal direction defining a median plane, the footwear article will also comprise stops to limit the amplitude of rotation in the median plane to a value of between 50 degrees and 60 degrees.

This will make it possible to avoid trauma or injuries while permitting great freedom of movement.

According to a supplementary feature the invention provides that each footwear article will also comprise stops to limit the amplitude of rotation in the longitudinal direction to a value between 25 degrees and 35 degrees.

Translational movement of the axis of the articulations in relation to the body, if of small amplitude, advantageously between 5 millimeters and 15 millimeters, will nevertheless provide freedom of movement while effectively holding the user's ankle.

Figure 1:
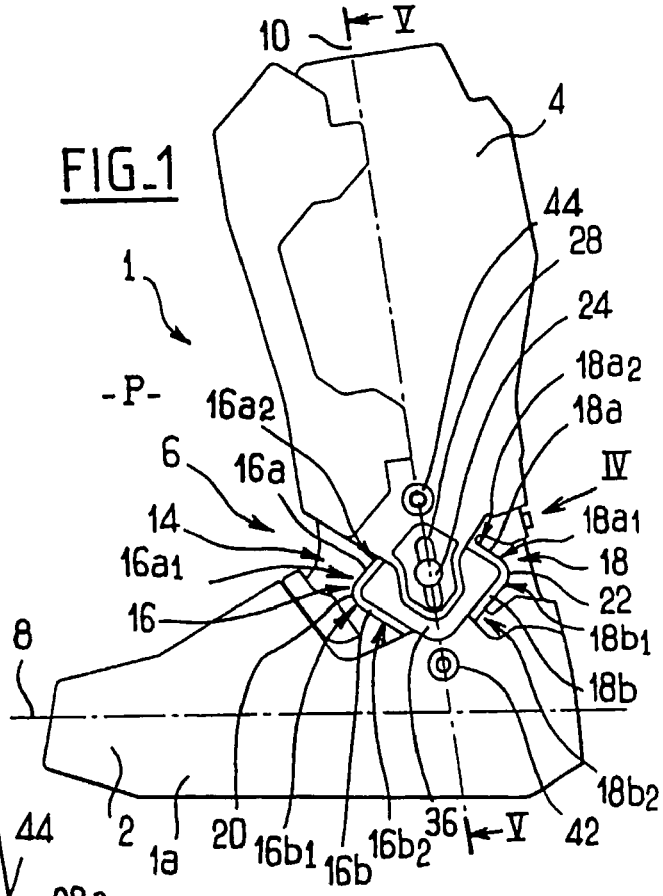
Figure 2:
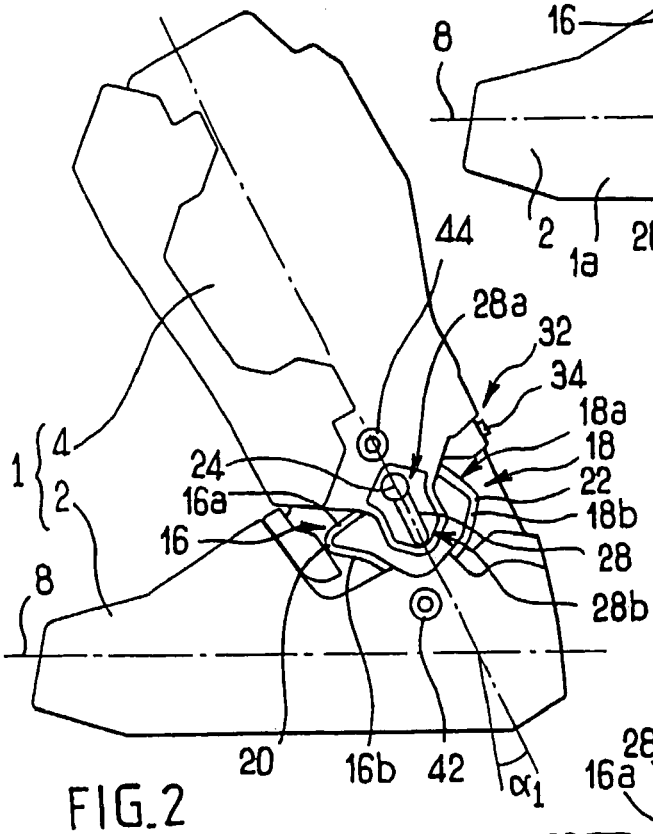
Figure 3:
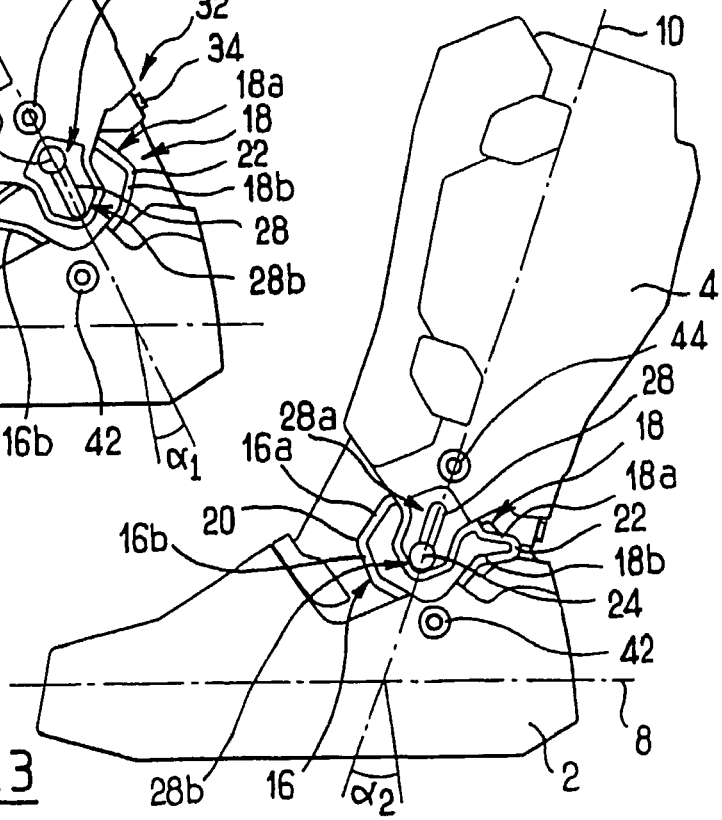
Figure 7:
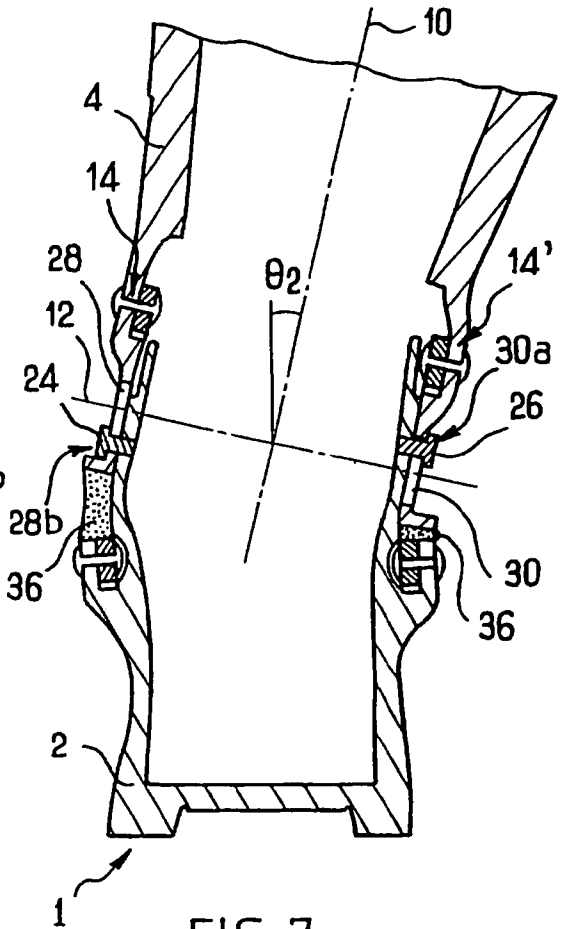
Figure 6:
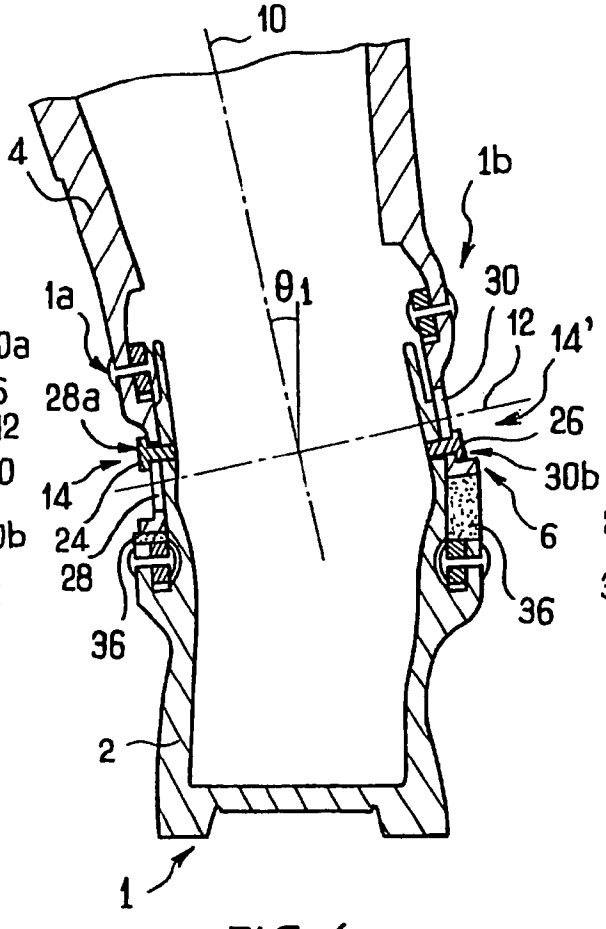
Figure 5:
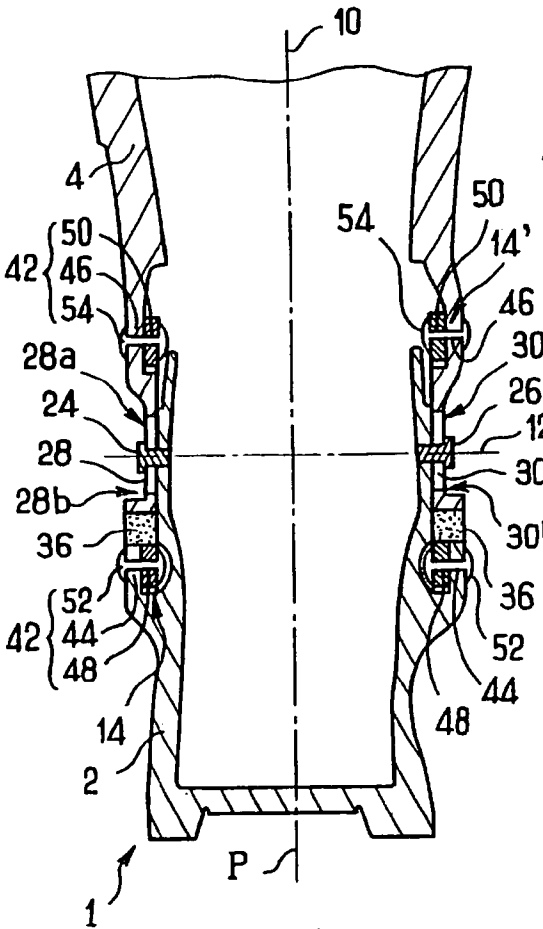
Figure 8:
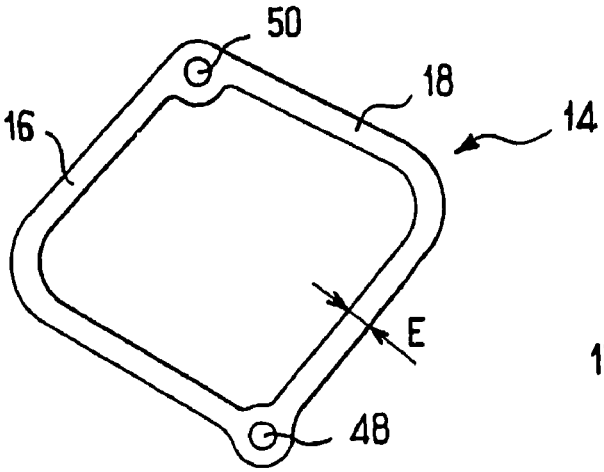
Figure 9:
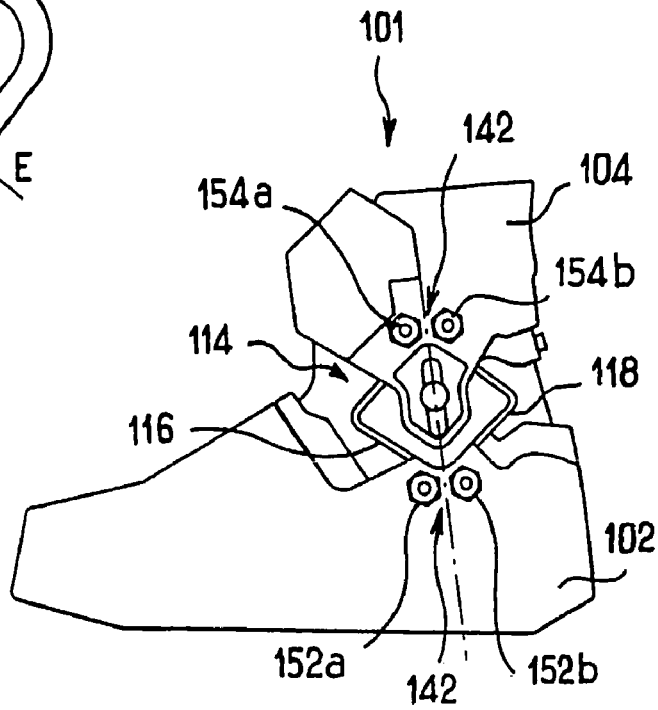
Figure 10:
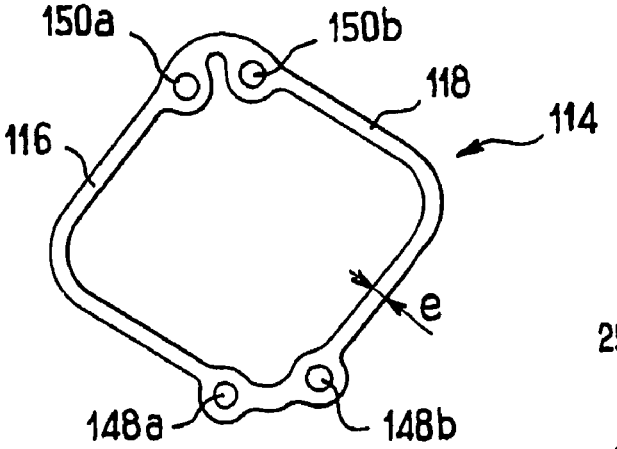
Figure 11:
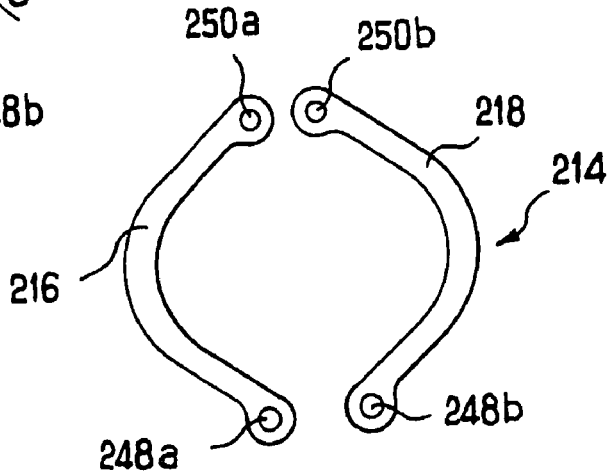

The invention will be even more clearly apparent from the following description with reference to the appended drawings in which:

FIG. 1 illustrates a motorcycle boot according to the invention in the resting position, FIG. 2 illustrates the boot in FIG. 1 in a flexed position, FIG. 3 illustrates the boot in FIG. 1 in an extended position, FIG. 4 is a view along the arrow identified by IV in FIG. 1, FIG. 5 is a view in cross-section along the arrow identified by V-V in FIG. 1, in the resting position, FIG. 6 is a view according to FIG. 5 in the forward position of the boot, FIG. 7 is a view according to FIG. 5, in the backward position of the boot, FIG. 8 is an enlarged view of the articulation alone, FIG. 9 illustrates a variant motorcycle boot according to the invention, FIG. 10 is a enlarged view of the articulation only of the motorcycle boot variant illustrated in FIG. 9, FIG. 11 is a variant articulation.

FIGS. 1 to 7 illustrate a boot 1 comprising a body 2 below intended to receive the foot of a user, and a top 4 above, intended to receive the leg of a user, and in-between an articulation device 6 connecting top 4 to body 2.

Body 2 and top 4 each comprise a relatively rigid shell designed to protect the user's lower limbs. These shells may be locally perforated. They are lined on the inside for the user's comfort and may be lined on the outside. The body extends in a substantially horizontal longitudinal direction 8 when the user places his foot on a horizontal surface, while the top extends in a substantially vertical upward direction 10.

Longitudinal direction 8 and upward direction 10 define a median plane P parallel to the plane of illustration in FIGS. 1 to 3. The boot has an inner side 1*a* and an outer side 1*b* on either side of median plane P.

Boot 1 also has a transverse direction 12 extending substantially perpendicular to longitudinal direction 8 and upward direction 10.

The articulation device comprises two structures 14, 14' having an elastically deformable geometry arranged substantially symmetrically in relation to plane P, one on inner side 1*a* and the other on outer side 1*b*.

Each structure 14, 14' mainly comprises a front rib 16 and a rear rib 18 (the ribs of structure 14' cannot be seen in the figures), each curving inward, of a substantially V, U or C shape. Each rib comprises an upper limb 16*a*, 18*a* and a lower limb 16*b*, 18*b*. Each limb 16*a*, 16*b*, 18*a*, 18*b* extends between a first extremity $\mathbf{16}a_1$, $\mathbf{16}b_1$, $\mathbf{18}a_1$, $\mathbf{18}b_1$ respectively and a second extremity $\mathbf{16}a_2$, $\mathbf{16}b_2$, $\mathbf{18}a_2$, $\mathbf{18}b_2$ respectively.

The first extremities $\mathbf{16}a_1$, $\mathbf{16}b_1$ of the limbs of front rib 16 are connected together in a front apical area 20 to permit rotation between upper limb 16*a* and lower limb 16*b*. The first extremities $\mathbf{18}a_1$, $\mathbf{18}b_1$ of the limbs of rear rib 18 are connected together in a rear apical area 22 permitting rotation between upper limb 18*a* and lower limb 18*b*.

The second extremities $\mathbf{16}b_2$, $\mathbf{18}b_2$ of the lower limbs are secured to body 2, while the second extremities $\mathbf{16}a_2$, $\mathbf{18}a_2$ of the upper limbs are secured to top 4.

Front rib 16 and rear rib 18 have more the shape of an open V, as illustrated in FIGS. 1 to 3, when apical areas 20, 22 are very close together, more the shape of an open U when these areas 20, 22 are relatively far apart, and more the shape of a C when the areas 20, 22 are well apart.

They are advantageously arranged in opposition, in other words symmetrically in relation to upward direction 10. Here they open opposite each other in such a way that each structure 14 substantially has the shape of a deformable parallelogram. As an alternative they may be placed back to back so that each structure 14 substantially has a deformable >< shape.

Articulation device 6 further comprises two pivots 24, 26 extending substantially in the transverse direction between front rib 16 and rear rib 18. They are attached to body 2 and each slide in a groove 28, 30 made in top 4. Grooves 28, 30 are each of oblong shape and substantially extend along upward direction 10 between an upper extremity 28*a*, 30*a* and a lower extremity 28*b*, 30*b* advantageously approximately 10 millimeters apart.

Thus pivots 24, 26 control the deformation of structures 14, 14' and can move in the upward direction so that variable geometry structures 14, 14' thus define a floating articulation device substantially positioned level with the malleolus on either side of a user's ankle.

As illustrated in FIGS. 1 and 2, when the user's ankle makes a flexing movement about transverse direction 12, top 4 pivots around pivots 24, 26, limbs 16*a*, 16*b* of front limbs 16 approach each other through the deformation of front apical areas 20, whereas limbs 18*a*, 18*b* of rear ribs 18 move apart through the deformation of rear apical areas 22.

As illustrated in FIGS. 1 and 3, articulation device 6 deforms inversely in an extension movement, front ribs 16 moving apart and rear ribs 18 moving together.

Furthermore, during these flexion and extension movements upper limbs 16*a*, 18*a* pivot in relation to top 4 through elastic deformation close to their second extremities $\mathbf{16}a_2$, $\mathbf{18}a_2$ in the same way that lower limbs 16*b*, 18*b* pivot in relation to body 2 through elastic deformation in the vicinity of their second extremities $\mathbf{16}b_2$, $\mathbf{18}b_2$.

As pivots 24, 26 can slide in grooves 28, 30, in the position of extreme flexion top 4 abuts against body 2 at the front and pivots 24, 26 approach the upper extremities 28*a*, 30*a* of grooves 28, 30 to follow the movement of the user's malleolus. If the flexural movement were to be continued, pivots 24, 26 would tend to slide towards the bottom extremity of grooves 28, 30. As such a movement would likely to be damaging to the user, boot 1 also comprises a rear stop device 32.

As illustrated in FIG. 4, this rear stop device 32 designed to restrict flexural movement comprises a stud with a swollen head 34 integral with body 2 and sliding in a groove 40 of oblong shape provided in top 4. The extreme positions of swollen head stud 34 corresponding to maximum flexion and extension are represented by dotted and dashed lines in FIG. 4.

As identified in FIG. 2, the amplitude $\alpha_1$ of the flexural movement permitted by articulation device 6 is approximately 25 degrees in relation to the initial position illustrated in FIG. 1.

In a position of extreme extension top 4 abuts against body 2 at the rear and pivots 24, 26 abut against the lower extremities 28*b*, 30*b* of grooves 28, 30.

As referenced in FIG. 3, the amplitude $\alpha_2$ of the extension movement permitted by articulation device 6 is approximately 30 degrees in relation to the initial position illustrated in FIG. 1.

Through their parallelogram geometry, structures 14, 14' also permit lateral deformation in a direction substantially parallel to longitudinal direction 8, in order to accompany the user's foot in its movements towards forward leaning and backward leaning positions and its combined torsional movements.

As illustrated in FIGS. 5 and 6, when a user's ankle moves towards a forward position upper limbs 16*a*, 18*a* move towards each other through deformation of front apical area 20 and rear apical area 22 of lower limbs 16*b*, 18*b*. In addition to this pivot 24 moves towards the upper extremity 28*a* of groove 28.

Conversely, as far as structure 14' is concerned, the upper limbs move away from the lower limbs through deformation of the front and rear apical areas. In addition to this pivot 26 moves towards the lower extremity 26*b* of groove 26.

In the extreme forward position of the boot pivot 24 abuts against the upper extremity 28*a* of groove 28 and pivot 26 abuts against the lower extremity 26*b* of groove 26. The amplitude $\theta_1$ of the forward movement permitted by articulation device 6 in relation to the initial position illustrated in FIG. 5 is approximately 15 degrees.

As illustrated in FIGS. 5 and 7, conversely, in a backward movement of a user's ankle upper limbs 16*a*, 18*a* move away from lower limbs 16*b*, 18*b* through the deformation of front apical area 20 and rear apical area 22. In addition to this pivot 24 moves towards the lower extremity 28*b* of groove 28.

As far as structure 14' is concerned, the upper limbs move towards the lower limbs through deformation of the front and rear' apical areas. In addition to this pivot 26 moves towards the upper extremity 26*a* of groove 26.

In the extreme backward position of the boot, pivot 24 abuts against the lower extremity 28*b* of groove 28 and pivot 26 abuts against the upper extremity 26*a* of groove 26. The amplitude $\theta_2$ of the backward movement permitted by articulation device 6 in relation to the initial position illustrated in FIG. 5 is approximately 15 degrees.

Articulation device 6 further comprises an elastically deformable damping material 36 which differs from that comprising ribs 16, 18. This damping material 36 is located between ribs 16, 18 and fills the space separating limbs 16*a*, 16*b*; 18*a*, 18*b* of the ribs.

When structures 14, 14' deform in relation to the initial position, damping material 36 is stretched or compressed. It therefore exerts an increasing resistance force which will prevent or at least reduce the speed of impact when the articulation device reaches the stop.

Advantageously damping material 36 appended to structure 14, in other words located on inner side 1*a*, and that adjacent to structure 14', in other words located on outer side 1*b*, are different, in order to obtain asymmetric behaviour of articulation device 6. Likewise structures 14, 14' may have different mechanical characteristics as indicated previously.

The material of structures 14, 14' with elastically deformable geometry advantageously comprises man-made polymers such as polyamides or polyurethanes. The damping material advantageously has weaker mechanical strength characteristics. It may in particular comprise polyurethane foam or an elastomer.

As illustrated, structures 14, 14' are each separate from body 2 and top 4. Each structure 14, 14' here forms a single piece and incorporates front rib 16 and rear rib 18 into one piece. The said structures each comprise two fixing holes 48, 50 and are respectively secured to body 2 by a rivet 52 passing through fixing hole 48 provided in the structure and a fixing hole 44 provided in body 2, and to top 4 through a rivet 54 passing through fixing hole 50 provided in the structure and a fixing hole 46 provided in top 4.

Fixing holes 44 in the body, fixing holes 46 in the top, fixing holes 48, 50 in structure 14 and rivets 52, 54 constitute the means of attachment 42 for structure 14 to body 2 and top 4. Structure 14' comprises identical means of attachment.

FIG. 9 illustrates a boot 101 intended for the practice of roller blading, after it has been fixed to a base (not shown) bearing a number of rollers. Items corresponding to those in FIGS. 1 to 8 have a reference number which is increased by 100.

Boot 101 is essentially distinguished from boot 1 in that ribs 116, 118 in each of the articulation structures have a cross-section and in particular here a thickness $\underline{e}$ (which is substantially constant) substantially less than the thickness $\underline{E}$ of ribs 16, 18. Thus the flexing force of boot 101 is less than that of boot 1.

The material of the ribs may also be changed to alter the flexion modulus of the boot, using carbon for example instead of a plastics material.

Top 104 of boot 101 is substantially shortened in comparison with top 4 of boot 1 in that protection for roller blading does not need to cover a large part of the leg.

In order to illustrate a variant of attachment means 142, the fixing holes have been doubled in comparison with attachment means 42 and comprise two fixing holes in body 102 and two fixing holes in top 104, with which four corresponding holes in structure 114—148*a*, 148*b*, 150*a*, 150*b* respectively—coincide. In addition to this the two rivets 52, 54 have been replaced by four bolts 152*a*, 152*b*, 154*a*, 154*b* which allow for easier replacement of structure 114. As an alternative to rivets and bolts pins or any other means performing the same function may be provided.

Of course once the most satisfactory means of attachment has been determined it is preferable that the number of fixing holes should not be changed from one boot to another, so that one articulation device can be replaced by any other device.

FIG. 11 illustrates an articulation structure 214 which is perfectly capable of replacing structure 114 in that it comprises four fixing holes 248*a*, 248*b*, 250*a*, 250*b*, because these coincide perfectly with the fixing holes in body 102 and top 104.

This articulation structure 214 is essentially distinguished from structure 114, apart from its cross-section, in that it comprises a front rib 216 which is separate from rear rib 218 and in that the ribs are substantially C shaped.

Of course the various means of attachment described and the various structures described may be combined together and used with each of the boots illustrated.

The invention claimed is:

1. A set comprising:

a first footwear article (1) intended for the practice of a first sport comprising:

a first rigid shell defining a body (2) intended to receive the foot of a first user and extending in a longitudinal direction (8), a second rigid shell defining a top (4) intended to receive the leg of the user and substantially extending in an upward direction (10), an articulation (6) connecting the body and the top having specific mechanical resistance characteristics, a second footwear article (101) also intended for the practice of a second sport, comprising:

a first rigid shell defining a body (102) intended to receive the foot of a second user and extending in a longitudinal direction (108), a second rigid shell defining a top (104) intended to receive the leg of the user and substantially extending in an upwards direction (110), an articulation (106) connecting the body and the top having specific mechanical resistance characteristics, wherein, the first shell (2) of the first footwear article (1) is substantially identical to the first body (102) of the second footwear article (101), the second body (4) of the first footwear article (1) and the second body (104) of the second footwear article (101) are similar, the mechanical characteristics of the articulation (6) of the first footwear article (1) and the mechanical characteristics of the articulation (106) of the second footwear article (101) are substantially different in order to correspond to the physiological differences between the first and second user and/or differences between the first and second sport, the articulation of the first footwear article and the articulation of the second footwear article each comprise two elastically deformable members (14, 14') symmetrically arranged in relation to the upward direction (10), and each elastically deformable member comprises two ribs (16, 18; 116, 118; 216, 218) which are substantially inwardly curved and positioned opposite each other.

2. A set according to claim 1, characterised in that the second shell (4) of the first footwear article (1) is substantially identical to the second shell (104) of the second footwear article (101).

3. A set according to claim 1, characterised in that for each footwear article (1; 101) the articulation (6; 106) is separate from the first shell (2; 102) and the second shell (4; 104), and the articulation (6) of the first footwear article (1) can replace the articulation (106) of the second footwear article (101) and vice versa.

4. A set according to claim 1, characterised in that the articulation (6; 106) of each footwear member (1; 101) permits rotation of the top in relation to the body about two axes of rotation (8, 12) which are substantially perpendicular to each other and lateral movement of the articulations in relation to the body in order to bring the axes of rotation of the articulation substantially in line with the axes of rotation of the foot in relation to the user's leg.

5. A set according to claim 1, characterised in that the ribs (16, 18) of the first footwear article (1) and the ribs (116, 118) of the second footwear article (101) are made of different materials.

6. A set according to claim 1, characterised in that the ribs (16, 18) of the first footwear article (1) and the ribs (116, 118) of the second footwear article (101) have different cross-sections (E, e).

7. A set according to claim 1, characterised in that the two elastically deformable members (14, 14') for each footwear article have different mechanical characteristics.

8. A set according to claim 1, characterised in that:

the upward direction and the longitudinal direction in each footwear article define a median plane, each footwear article comprises stops to limit the amplitude of rotation ($\alpha_1$, $\alpha_2$) in the median plane to a value of between 50 degrees and 60 degrees.

9. A set according to claim 1, characterised in that each footwear article comprises stops to restrict the amplitude of rotation ($\theta_1$, $\theta_2$) along the longitudinal direction to a value of between 25 degrees and 35 degrees.

10. A set according to claim 1, characterised in that the amplitude of lateral movement of the articulation axis in each footwear article in relation to the body is between 5 millimeters and 15 millimeters.

11. The set of claim 1, wherein, the thickness of the ribs (16, 18) of the first footwear article (1) is different from the thickness of the ribs (116, 118) of the second footwear article (101).

12. Set according to claim 1, wherein, the mechanical characteristics of the articulation (6) of the first footwear article (1) and the mechanical characteristics of the articulation (106) of the second footwear article (101) are substantially different in order to correspond to the differences between the first sport and the second sport.

13. A footwear set comprising:

first footwear article (1) for the practice of a first sport, comprising i) a first rigid shell defining a body (2) to receive the foot of a first user and extending in a longitudinal direction (8), ii) a second rigid shell defining a top (4) intended to receive the leg of the user and substantially extending in an upward direction (10), and iii) an articulation (6) connecting the body and the top having specific mechanical resistance characteristics; and a second footwear article (101) intended for the practice of a second sport, comprising i) a first rigid shell defining a body (102) intended to receive the foot of a second user and extending in a longitudinal direction (108), ii) a second rigid shell defining a top (104) intended to receive the leg of the user and substantially extending in an upwards direction (110), and iii) an articulation (106) connecting the body and the top having specific mechanical resistance characteristics, wherein, the first shell (2) of the first footwear article (1) is substantially identical to the first body (102) of the second footwear article (101), the second body (4) of the first footwear article (1) and the second body (104) of the second footwear article (101) are similar, mechanical characteristics of the articulation (6) of the first footwear article (1) and mechanical characteristics of the articulation (106) of the second footwear article (101) are substantially different in order to correspond to physiological differences between the first user and the second user and differences between the first sport and the second sport, the articulation of the first footwear article and the articulation of the second footwear article each comprise two elastically deformable members (14, 14') symmetrically arranged in relation to the upward direction (10), and each elastically deformable member comprises two ribs (16, 18; 116, 118; 216, 218) which are substantially inwardly curved and positioned opposite each other.

14. The set of claim 13, wherein, the two elastically deformable members (14, 14') of each articulation (6) are arranged substantially symmetrically in relation to a plane (P), one member on an inner side (1*a*) and another member on an outer side (1*b*), the two ribs comprises a front rib (16) and a rear rib (18), each rib curving with an upper limb (16*a*, 18*a*) and a lower limb (16*b*, 18*b*) and extending between a first extremity ($\mathbf{16}a_1$, $\mathbf{16}b_1$, $\mathbf{18}a_1$, $\mathbf{18}b_1$) and a second extremity ($\mathbf{16}a_2$, $\mathbf{16}b_2$, $\mathbf{18}a_2$, $\mathbf{18}b_2$), the first extremities of the limbs of the front rib (16) are connected together in a front apical area (20) to permit rotation between the upper limb (16*a*) and the lower limb (16*b*), the first extremities ($\mathbf{18}a_1$, $\mathbf{18}a_1$) of the limbs of rear rib (18) are connected together in a rear apical area (22) permitting rotation between the upper limb (18*a*) and the lower limb (18*b*), and the second extremities ($\mathbf{16}b_2$, $\mathbf{18}b_2$) of the lower limbs are secured to the body (2) and the second extremities ($\mathbf{16}a_2$, $\mathbf{18}a_2$) of the upper limbs are secured to the top (4).

15. The set of claim 14, wherein, the front rib and rear rib are arranged in opposition symmetrically in relation to the upward direction so they open opposite each other in such a way that each structure 14 substantially has the shape of a deformable parallelogram. As an alternative they may be placed back to back so that the deformable member (14) takes on a substantially deformable >< shape.

16. The set of claim 14, wherein, each articulation (6) further comprises two pivots (24, 26) extending substantially in a transverse direction between the front rib (16) and the rear rib (18), the pivots attached to the body (2) and sliding in a groove (28, 30) in the top (4), the grooves each of oblong shape and substantially extending along the upward direction (10) between the upper extremity (28*a*, 30*a*) and the lower extremity (28*b*, 30*b*), the pivots control the deformation of the deformable member.

17. The set of claim 13, wherein, the ribs (16, 18) of the first footwear article (1) and the ribs (116, 118) of the second footwear article (101) are made of different materials.

18. The set of claim 13, wherein, the cross-sections of the ribs (16, 18) of the first footwear article (1) are different from the cross-sections of the ribs (116, 118) of the second footwear article (101).

19. The set of claim 13, wherein, the mechanical characteristics of the two elastically deformable members (14, 14') of the first footwear article (1) are different from the mechanical characteristics of the two elastically deformable members (14, 14') of the second footwear article (101).

20. The set of claim 13, wherein, the thickness of the ribs (16, 18) of the first footwear article (1) is different from the thickness of the ribs (116, 118) of the second footwear article (101).

* * * * *